US008701433B2

(12) United States Patent
Haseldine, Jr.

(10) Patent No.: US 8,701,433 B2
(45) Date of Patent: Apr. 22, 2014

(54) EVAPORATOR DOOR SYSTEM WITH MOVABLE DOOR

(76) Inventor: Michael Cyril Haseldine, Jr., Annapolis, MD (US)

( * ) Notice: Subject to any disclaimer, the term of this patent is extended or adjusted under 35 U.S.C. 154(b) by 1400 days.

(21) Appl. No.: 12/059,678

(22) Filed: Mar. 31, 2008

(65) Prior Publication Data

US 2009/0242185 A1 Oct. 1, 2009

(51) Int. Cl.
*F25D 17/06* (2006.01)
*F25B 47/02* (2006.01)
*F24F 11/02* (2006.01)

(52) U.S. Cl.
USPC ..... 62/272; 62/278; 62/283; 62/284; 62/419; 62/80; 160/DIG. 1; 165/98; 165/99

(58) Field of Classification Search
USPC ..... 165/98, 99, 41; 160/DIG. 1; 62/80, 272, 62/278, 283, 419
See application file for complete search history.

(56) References Cited

U.S. PATENT DOCUMENTS 1,257,640 A * 2/1918 Rothschild ..... 165/98
1,358,224 A * 11/1920 McClain ..... 160/31
1,404,786 A * 1/1922 Middaugh ..... 160/271
2,056,128 A * 9/1936 Twombly ..... 160/239
2,340,982 A * 2/1944 Patterson ..... 160/25
2,840,827 A 7/1958 Calvano
3,529,436 A * 9/1970 Brennan ..... 62/272
3,572,052 A * 3/1971 Toth ..... 62/278
3,900,063 A 8/1975 Roller
4,064,306 A * 12/1977 Scotchmer et al. ..... 442/3
4,114,233 A 9/1978 Hamilton
4,342,354 A 8/1982 Leivenzon et al.
4,669,206 A * 6/1987 Yost ..... 37/285
5,088,543 A * 2/1992 Bilbrey ..... 160/310
5,333,664 A * 8/1994 Sirianni et al. ..... 160/23.1
5,520,006 A 5/1996 Middleton
5,724,925 A * 3/1998 Ito ..... 123/41.49
6,282,822 B1 9/2001 Rinzler et al.
6,631,590 B1 * 10/2003 Glowaski ..... 52/63
6,631,749 B1 10/2003 Zabala
6,708,755 B1 3/2004 Meter

FOREIGN PATENT DOCUMENTS

JP 10140695 A * 5/1998
JP 2000146373 A * 5/2000

OTHER PUBLICATIONS

Office Action issued Mar. 1, 2012, in Chinese Patent application No. 200980111222.8 submitting English translation only.

* cited by examiner

*Primary Examiner* — John Ford
(74) *Attorney, Agent, or Firm* — Oblon, Spivak, McClelland, Maier & Neustadt, L.L.P.

(57) ABSTRACT

A heat exchanger door system includes a heat exchanger and a first rotatable member, proximate to the heat exchanger, that rotates about an axis of rotation. The system includes a first door member rolled around the rotatable member and movable from a rolled position to an unrolled position in which the first door member covers more of the heat exchanger than when the door member is in the rolled position.

24 Claims, 5 Drawing Sheets

EVAPORATOR DOOR SYSTEM WITH MOVABLE DOOR

BACKGROUND OF THE INVENTION

1. Field of the Invention

This invention relates to a movable member configured to partially or fully isolate a heat exchanger from an environment. In one example, the movable member is disposed within a cooling system such as a freezer, and isolates one or more heat exchangers within the freezer from an interior of the freezer during a defrost operation.

2. Description of the Related Art

In cooling systems such as freezers and refrigerators, moisture from the air entering the cooling system through open doors, small passages in the walls or floors, and from the product stored within the cooling system frequently collects on heat exchanger coils and heat exchanger fins in the form of ice. During long operation, ice can accumulate on the coils and fins creating a blockage that impedes the airflow over the heat exchanger and creates a loss in efficiency in operation of the cooling system.

Typical heat exchangers increase or decrease temperature by running fluid through manifolds that feed loops of tubes. The tubes frequently have fins attached to them. The purpose of the fins is to increase the effective surface area of the tubes in order to increase the rate of heat exchange. Air flow is typically provided by fans which blow or draw air across the finned tubes. A heat exchanger rating, typically listed in British Thermal Units "BTU," depends on the number of air cycles which go through the finned tubes per minute. In a freezing application, constriction of the fins or tubes due to ice build up reduces the number of air changes that are allowed to occur. This in turn reduces the heat exchanger's capacity. Accordingly, many heat exchangers in cooling systems must be regularly defrosted in order to maintain sufficient cooling capacity. In order to provide efficient defrosting of individual heat exchangers without requiring defrosting an entire freezer, sequential defrost units have been developed.

One objective of a sequential defrost unit is to maintain temperature and freezing/cooling of stored or processed product while providing defrost in one or more heat exchangers at a time. One issue in providing sequential defrost is a difficulty in effectively isolating the one or more heat exchangers in the defrost stage while running other heat exchangers in the cooling system.

Some conventional sequential cooling systems are designed with sufficient capacity to allow for at least one heat exchanger to be defrosted while the remaining heat exchangers can accommodate the refrigeration load in the application. In other words, if the required cooling capacity is ninety tons of refrigeration, one would provide a one-hundred-and-twenty ton capacity in four heat exchangers, i.e., thirty tons in each heat exchanger. With the above-noted arrangement, when one heat exchanger is in defrost, the remaining three heat exchangers provide the required ninety ton refrigeration capacity. Conventional sequential cooling systems often attempt to isolate the heat exchanger undergoing defrost with mechanical louvers or shutters. However, the louvers or shutters themselves can become coated or clogged with ice and cease to adequately isolate the heat exchanger during its defrost stage. In some cases, the shutters freeze in the open or closed position. When this clogging occurs, air flow around the heat exchanger undergoing defrost can be disrupted, which can result in an increased amount of time required to defrost the heat exchanger. Furthermore, warm air from the heat exchanger undergoing defrost can leak into the cooling system at large, resulting in an increased heat load on the heat exchangers that are not being defrosted.

SUMMARY OF THE INVENTION

Accordingly, one aspect of the present invention is to allow the sequential defrost of individual evaporators (otherwise know as heat exchangers) while maintaining desired airflow and design temperature in the cooling system. One example of the invention provides movable doors or screens configured to unroll from a stored position to be placed over each evaporator front and/or back side. In one example, the doors are controlled via a PLC and/or frost detection devices. The controller directs the doors to move, for example, downward, into a closed position or upward into an open position. When these doors are closed, i.e., in an unrolled position, the heat exchanger is at least partially isolated from air movement in the remainder of the freezer created by any fans that are often included with cooling systems, especially large-scale cooling systems. Thus, in this example, airflow over the heat exchanger or heat exchangers undergoing defrost is reduced, and the heat exchangers will defrost more efficiently. Another aspect of the present invention is the containment of any heat produced in the defrosting heat exchanger during the defrost process. This containment creates a hot zone around the defrosting heat exchanger, which allows for a faster defrost time than some conventional defrosters. Additionally, the containment of the heat around the defrosting heat exchanger reduces the effect the defrosting heat exchanger on the area of the cooling system used to store items such as food.

One aspect of the invention uses two doors on each heat exchanger, one on the front side of the heat exchanger and one on the back side of the heat exchanger. In one example, the doors are nylon fabric doors. The doors can be moved to roll or unroll by one or more motors. In an example using one motor, there may be a linkage to actuate the door on one side, typically the back side, of the heat exchanger. Preferably, any doors, shafts, and tracks are compatible with the temperatures normally present in the cooling system. In one example, the doors can be quite wide. In certain embodiments, when the doors are wide, the door preferably includes a reinforcement or "wind rib" in the center of the door to help prevent the door from collapsing due to air movement within the cooling system.

One beneficial aspect of certain examples of the invention is the reduction in defrost time due to the concentration of heat used to defrost the heat exchangers. Another aspect of the invention is that the door or doors are can be placed in a rolled up (open position) or unrolled (closed position) within a hood, and thus, isolated from the freezer environment. Some aspects of the invention include a door with a weighted bar at the bottom. The weighted bar typically enhances the sealing effect of the door by pressing any sealing material against a sealing surface.

When in the down position, the doors may be subject to moisture buildup (condensation) on the side of the door facing the heat exchanger being defrosted. Accordingly, another aspect of the invention provides a scraper or squeegee to scrape off condensation from the door when the door moves into or out of a closed position. In one embodiment, the scraper is made from ultra-high molecular weight polyethylene (UHMW).

In one embodiment, the door comprises nylon based fabric. In a further example, the door has a coating of polyvinylchloride (PVC) laminate. In yet a further example, the doors include a water repellant such as a siliconized overcoat.

Another aspect of the invention includes a nozzle providing a loop of hot gas. The hot gas is typically bled from a main hot gas line used to defrost the heat exchanger. The loop heats the hood area to release moisture that could potentially freeze the door in an up position and risk tearing the door when the door is engaged to move.

The door may be enclosed in a hood when in an open or rolled-up position. In one example, the hood is stainless steel or insulated metal and encompasses most of the door when the door is in a rolled-up position. In one example, the only area exposed when the doors are in a rolled-up state is the bottom which remains outside of the hood area. The top of the hood can be pitched to drain moisture which may be created during the pre-defrost of the door, and the hood can be heated to reduce the build-up of ice on the rolled up door during normal non-defrost operation of the cooling system.

One aspect of the invention provides a door system for partially isolating a heat exchanger. In one example, the door system is provided as a kit for retrofitting existing heat exchanger equipment. Typically, the door system includes a first rotatable member configured to be attached proximate to the heat exchanger. The first rotatable member is configured to rotate about an axis of rotation. The system also includes a first door member rolled around the rotatable member and movable from a rolled position to an unrolled position in which the first door member extends farther away from the rotatable member than when the door member is in the rolled position. The system also typically includes a track configured to guide the first door member as the first door member moves from the rolled position to the unrolled position.

Benefits of certain examples of the present invention include providing shorter defrost cycle times because the heat exchanger is more effectively isolated during the defrost cycle than are heat exchangers in conventional cooling systems. This isolation typically results in saving electrical usage. As the movable door typically takes of little space within the cooling system, another benefit of the present invention is improved accessibility for cleaning and maintenance. The movable door can advantageously be retro-fit to existing systems, or installed in newly manufactured systems. One example of the present invention can provide a heat exchanger door system including a heat exchanger. The system further includes a first rotatable member, proximate to the heat exchanger. The rotatable member is configured about an axis of rotation. A first door member is rolled around the rotatable member and can move from a rolled position to an unrolled position in which the first door member covers more of the heat exchanger than when the door member is in the rolled position. In one example, the rotatable member is coupled to a motor and, optionally, a gearbox. In a preferred example, the first door member is at least partially contained in a track and slides within the track during a roll-up or roll-down process. In some examples, the there are two rotatable members, each including a door member. In one variation of this example, the two rotatable members are disposed in parallel with each other.

One aspect of the invention provides a door system for partially isolating a heat exchanger. The door system typically includes a first rotatable member, configured to be attached proximate to the heat exchanger, which rotates about an axis of rotation. The door system further typically includes means for covering the heat exchanger, the means for covering being rolled around the rotatable member and movable from a rolled position to an unrolled position in which the means for covering extends farther away from the rotatable member than when the means for covering is in the rolled position. The door system also further typically includes a track configured to guide the means for covering as the means for covering moves from the rolled position to the unrolled position.

BRIEF DESCRIPTION OF THE DRAWINGS

These and other advantages of the invention will become more apparent and more readily appreciated from the following detailed description of the exemplary embodiments of the invention taken in conjunction with the accompanying drawings where.

DETAILED DESCRIPTION OF THE PREFERRED EMBODIMENTS

Figure 1:
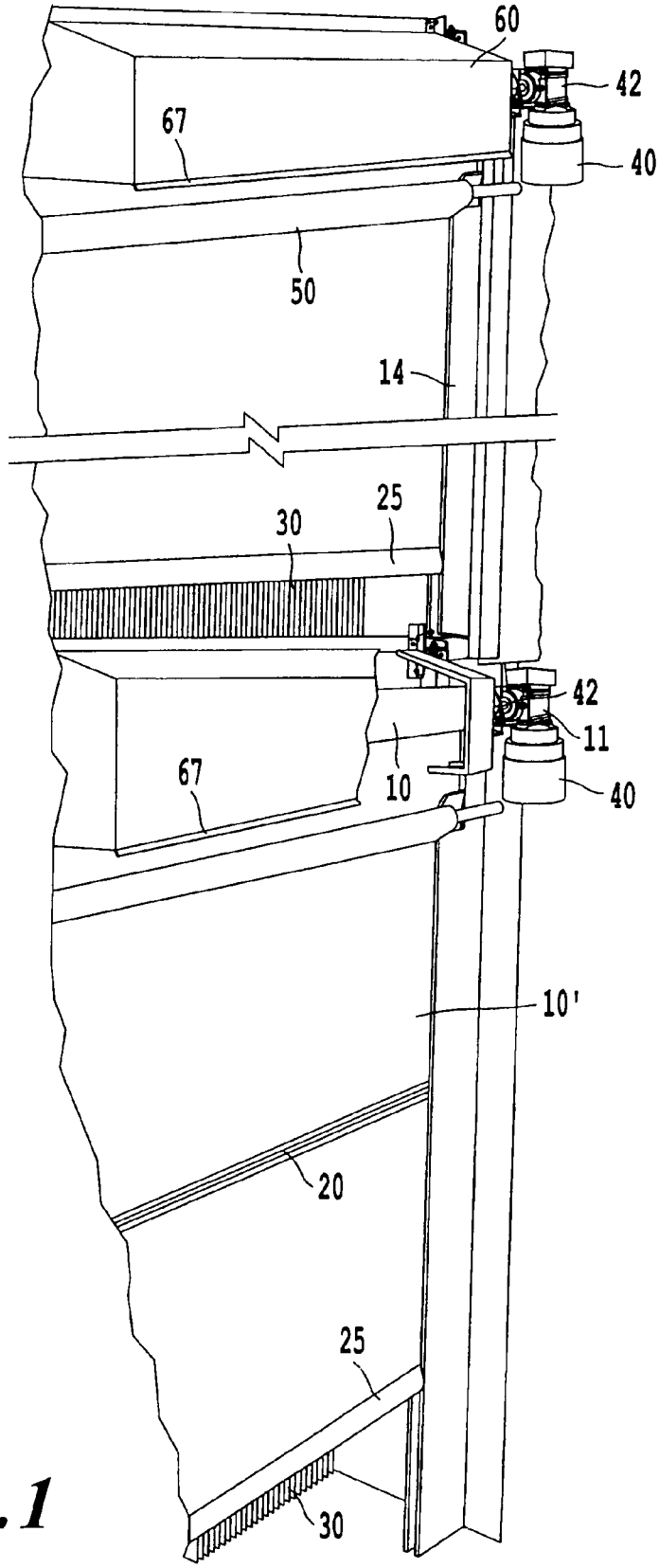
FIG. 1 is an isometric view of one example of the present invention.

With reference to FIG. 1, one example of a door system 1 is shown in perspective. In this arrangement, a door member 10 is shown rolled around a rotatable member or shaft 11. A portion of the door member is shown in an unrolled state and is designated 10'. The door member 10 shown in FIG. 1 and rotatable member 11 extend in a horizontal direction, but other orientations are sometimes used. For example, in some applications, the rotatable member 11 extends in vertical direction or is disposed at an acute angle with respect to the vertical or horizontal directions. Such configurations preferably include a door member 10 sufficiently stiff to roll and unroll in response to rotation of the rotatable member 11 without the help of gravity. In any case, the door member 10 is configured to roll or unroll around an axis of rotation X (shown in FIG. 2). When the door member 10 is in an unrolled state, the door member 10 covers a larger portion of the heat exchanger 30 than when the door is in a rolled state. In other words, the door member 10 unrolls to cover more of the heat exchanger 30 and rolls back up to cover less. In this way, the heat exchanger 30 can be at least partially isolated from the cooling system at large during a defrost process conducted on the heat exchanger 30.

Typically cooling systems will include a plurality of heat exchangers 30. During normal operation, it is useful to defrost the heat exchangers 30 individually while allowing the remaining heat exchangers 30 to remain on cooling duty. When a defrost of one of the heat exchangers 30 is performed, the door member 10 is typically unrolled to isolate the heat exchanger 30 from the rest of the cooling system. This isolation helps the heat exchanger 30 undergoing defrost to heat up faster than it would be able to if it were not isolated. Furthermore, the isolation of the heat exchanger 30 undergoing defrost helps keep the remainder of the cooling system cool by reducing leakage of heat from the defrosting heat exchanger 30 into the rest of the system.

FIG. 1 further shows a motor 40 and gearbox 42 coupled to the rotatable member 11. The motor 40 is configured to rotate the rotatable member 11 based on an input determined by an operator or by a controller 45 (shown in FIG. 2). In one example, the controller 45 includes a programmable logic controller (PLC). In another example, the controller 45 includes a personal computer (PC) including at least one input circuit and one output circuit, and the PC controls the motor 40 based on signals sent from at least one sensor 47 that determines whether the door member has unrolled and extended to a predetermined position. Typically the PC reads a computer readable medium including a program that rolls and unrolls the door member 10 based on a predetermined schedule or on input provided by one or more sensors in the cooling system.

The gearbox 42 is typically disposed near one end of the rotatable member 11 and can perform at least one of two functions. First, the gearbox 42 can reduce the rotational speed of the motor 40 to a level suitable for movement of the door member 10 from a rolled position to an unrolled position. The reduction of the rotational speed of the motor 40 also results in a corresponding increase in torque applied to the rotatable member 11. Additionally, the gearbox 42 can be used to change the direction of the output provided by the motor 40. In other words, the motor 40 may provide an output that rotates around a vertical axis of rotation, and the gearbox 42 can couple this vertical axis of rotation to a rotatable member 11 having a horizontal axis of rotation. One benefit of this arrangement is that the motor 40 can be positioned and oriented relatively compactly with respect to the door member 10 and rotatable member 11.

At least a portion, and preferably the majority of the door member is housed in the optional hood 60 when the door member is in a rolled up state. The hood 60 typically comprises sheet metal such as stainless steel, but other materials such as cold-resistant polymers or aluminum may be used. Additionally, the hood 60 preferably includes a layer of insulation 61 (shown in FIG. 4) to reduce heat transfer from inside the hood 60, where the rotatable member 11 resides, to an area outside the hood. The hood 60 typically includes an opening through which the door member 10 may extend when the door member 10 unrolls in response to rotation of the motor 40.

Figure 2:
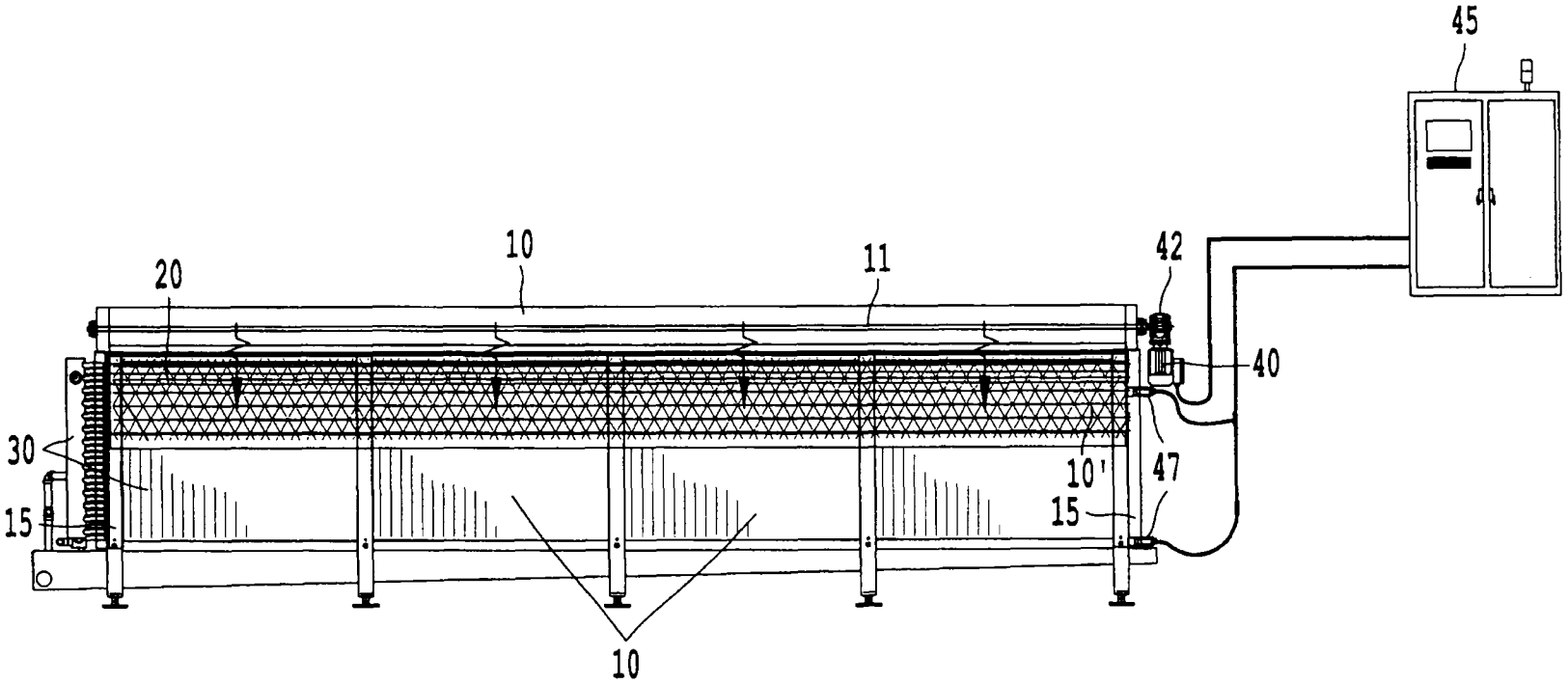
FIG. 2 is a front view of one example of the present invention.

FIG. 2 shows one example of a front view of the door system 1. In the depicted example, the door system 1 extends across multiple heat exchangers 30, which are typically defrosted together.

FIG. 2 depicts a track member 15 that guides the door member 10 as the door member 10 extends from a rolled position to an unrolled position. The track member 15 preferably prevents the door member 10 from flapping in response to the air movement that can occur inside the cooling system. The track member 15 also enhances isolation of the door member 10 relative to the cooling system at large. In one example, the track member 15 includes a sheet metal C or U-channel that accepts an edge of the door member 10'. The channel preferably includes stainless steel, but other materials such as cold-resistant polymers or aluminum may be used. The track member 15 is depicted in FIGS. 1 and 2 as a continuous channel, but in some embodiments, the track member 15 is discontinuous or even formed of a plurality separate members.

The door member 10 itself is typically comprised of woven nylon fabric. However, other types of flexible, rollable material may be used. In one example, the door member 10 is coated with a coating of polyvinylchloride (PVC) laminate. In another example, the doors include a water repellant material such as a siliconized overcoat.

The door member 10 optionally includes a rib 20 that helps reduce possible flapping of the door member 10 due to air movement within the cooling system 1. The rib 20 preferably includes a semi-rigid or rigid material such as stainless steel in order to enhance the rigidity of the door member 10. Preferably, the rib 20 extends in a direction parallel to the axis of rotation X in order to allow the rib 20 to be rolled up with the door member 10.

As further depicted in FIGS. 1 and 2, the door member 10 includes a bar 25 disposed at or near an outermost end of the door member 10. The door member 10 acts as a weight and helps pull the door member 10 downward when the door member 10 is being unrolled. Additionally, in some examples, the bar 25 functions similarly to the rib 20 inasmuch as the door member reduces flapping of the door member 10 due to air movement within the cooling system. The bar 25 is typically either wrapped within a loop of the door member 10 itself or attached to a portion of the door member 10 with an adhesive or by another material. In some cases, the bar 25 is replaced or supplemented by a plurality of individual weights, or by a flexible member such as a chain or cable, for example.

Figure 3:
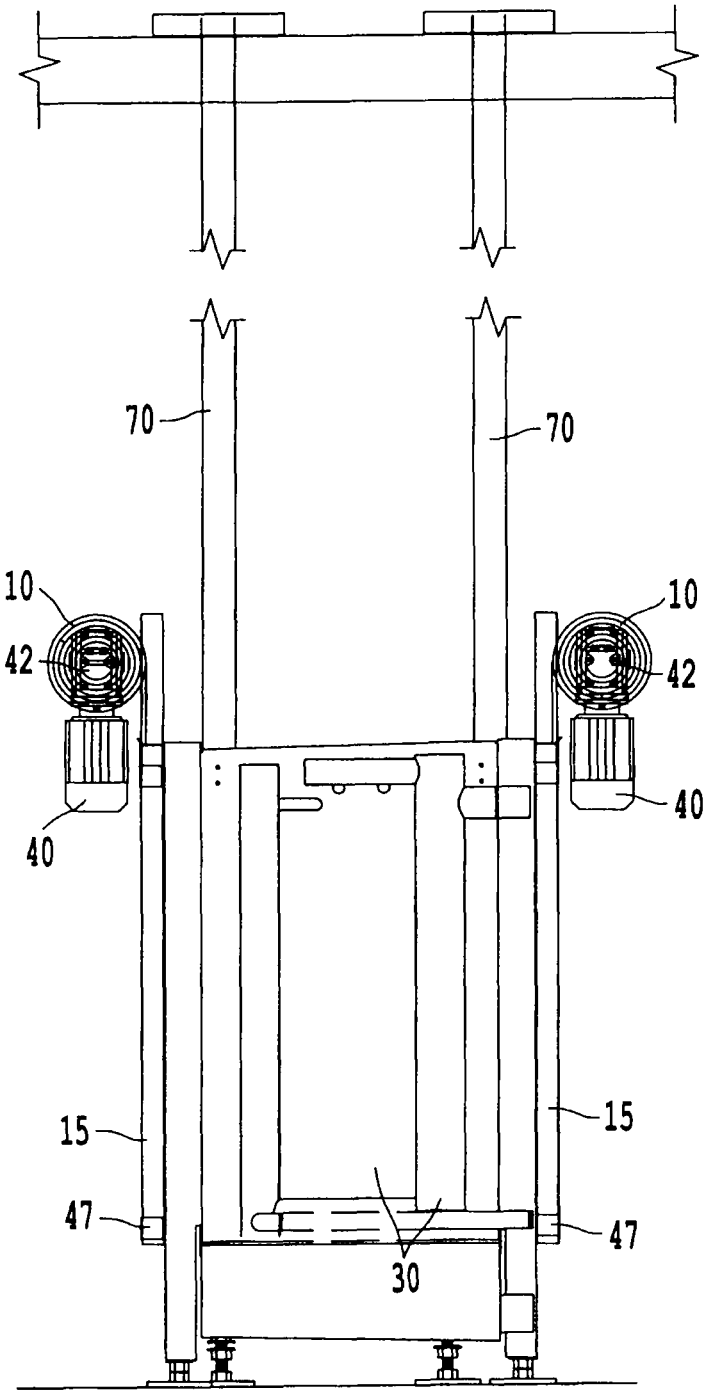
FIG. 3 is a right-side view of the example shown in FIG. 1.

FIG. 3 depicts one example of the door system 1 disposed on a front and back side of a heat exchanger 30. Thus, the heat exchanger 30 is substantially isolated from the rest of the cooling system inasmuch as the two door members 10 cover the heat exchanger 30 on a front and back side, respectively, the floor or base of the heat exchanger 30 blocks air flow out the bottom of the heat exchanger 30, and the top of the heat exchanger 30 is further covered by a roof or lid. In other words, the two door members 10 form sides of a compartment containing one or more heat exchangers 30. In order to prevent heat from remaining in the compartment and then exiting the compartment when one or more of the door members 10 is rolled up, the cooling system 1 shown in FIG. 3 provides heat evacuation piping 70 that removes heat from the compartment after the defrost process is completed.

Figure 4:
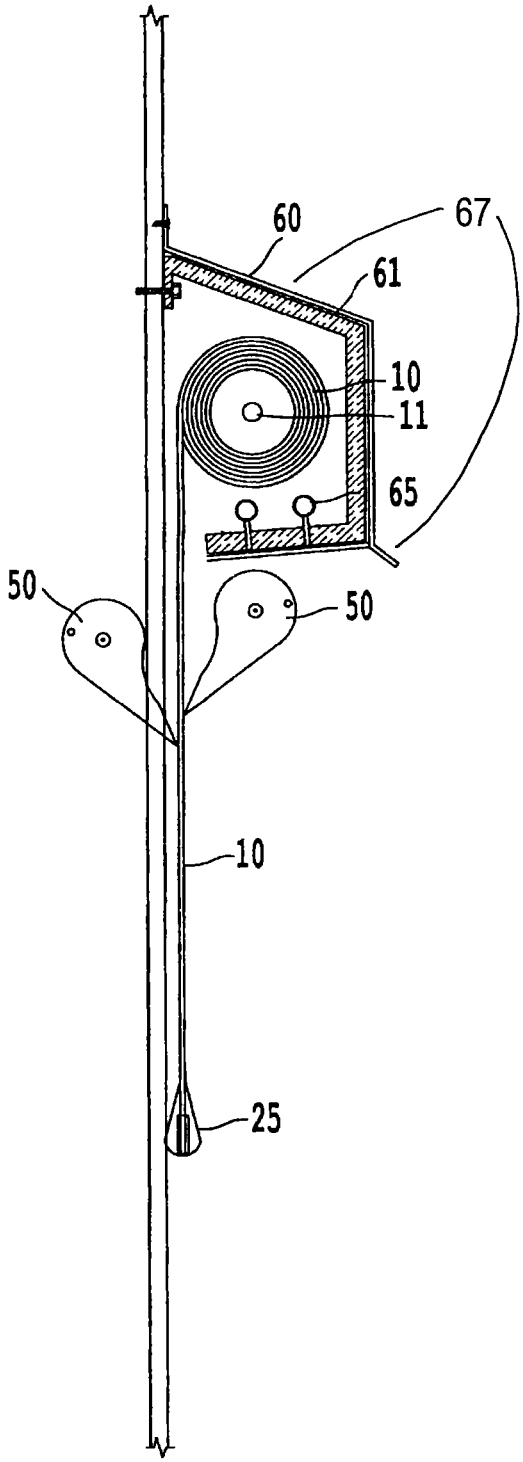
FIG. 4 is a detailed view of the example shown in FIG. 1.

FIG. 4 shows a detail view of a door member 10 and hood 60. As shown in FIG. 4, the hood 60 can include hot gas piping 65, which provides heat to the hood 60. The hot gas piping 65 heats both the hood 60 and the door member 10 in order to prevent or reduce the build up of ice on these components. In one example, the hot gas contained in the hot gas piping 65 is received by the hot gas piping 65 from a main hot gas line used to defrost the heat exchanger 30 itself. The insulation layer 61 reduces heat transfer from the inside of the hood to the outside of the hood. However, it is possible that melting of ice deposited on the outside of the hood 60 will still occur. Accordingly, one example of the hood 60 includes a pitched drain 67, which reduces the tendency of any melt water from depositing on the door member 10 or around the opening of the hood 60 during defrost.

As further shown in FIG. 4, the door system 1 can include one or more scraper 50. The scraper 50 is configured to brush against the door member 10 and remove condensation or even ice crystals from the door member 10 as the door member 10 extends or retracts. In one example, the scraper 50 pivots in response to pressure applied to it by the bar 25 during the rolling up or rolling down process, thus allowing the bar, which is typically thicker than the door member 10, to pass by the one or more scrapers 50 even though the scrapers 50 normally contact the thinnest part of the door member 10 itself.

As further shown in FIG. 4, the hood 60 can be attached to a framework of the heat exchanger 30 via screws. This arrangement allows the door member 10 and rotatable member 11 to be installed in areas in which the free space on the ends of the heat exchanger 30 is too short for the entire door member 10 and rotatable member to be slid into the hood 60 from one end in a direction parallel to the axis of rotation. This is particularly advantageous in systems where the door system 1 is installed as a retrofit onto older cooling systems.

Figure 5:
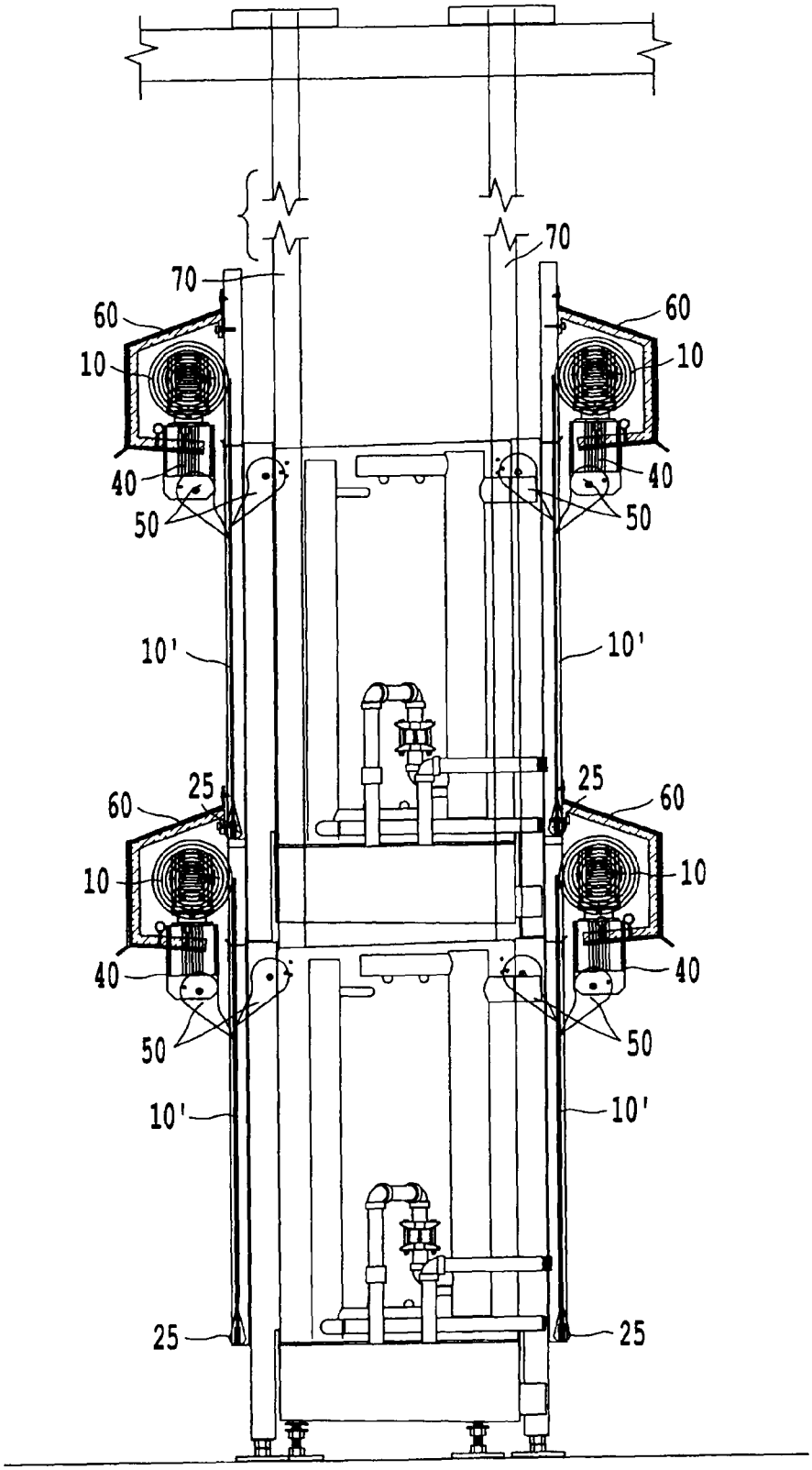
FIG. 5 shows the assembly shown in FIG. 1 in a dual-stacked configuration.

FIG. 5 depicts a stacked arrangement of four door members 10 and corresponding hoods 60. In some cooling systems, the heat exchangers 30 are stacked and require defrosting of upper heat exchangers 30 independently of defrosting of lower heat exchangers 30. In this arrangement, it is preferable for the controller 45 to individually control the various motors 40.

In some circumstances, it is preferable to build the rotatable member 11 and door member 10 etc. with the heat exchanger as an integral system. In other cases, the door system 1 is installed as a retrofit. In other words, existing refrigeration systems are upgraded to include the door system 1. In this case, the door system 1 can replace an existing door system or can supplement an existing door system. Alternatively, the door system 1 can be installed in refrigeration systems that have no previous door system for isolating heat exchangers.

Although only certain embodiments of this invention have been described in detail above, those skilled in the art will readily appreciate that many modifications are possible in the exemplary embodiment without materially departing from the novel teachings and advantages of this invention. Accordingly, all such modifications are intended to be included within the scope of this invention.

The invention claimed is:

1. An evaporator door system comprising:

a first refrigeration-driven evaporator that cools an environment using a compressed refrigerant;

a second refrigeration-driven evaporator that cools the environment using the compressed refrigerant;

a rotatable member, proximate to each of the first and second evaporators, respectively, that rotates about an axis of rotation;

a first door member rolled around the rotatable member and movable from a rolled position to an unrolled position in which the first door member covers more of the first evaporator than when the first door member is in the rolled position;

a second door member rolled around the respective rotatable member and movable from the rolled position to the unrolled position in which the second door member covers more of the second evaporator than when the second door member is in the rolled position;

a programmable controller including programmed instructions, which when executed, the controller controls the evaporator door system based on a predetermined schedule such that the first door member is in the unrolled position during a defrost operation performed on the first evaporator and the second door member is in the rolled position during the defrost operation performed on the first evaporator and a first scraper disposed in contact with a first face of the first door member.

2. The evaporator door system of claim 1, further comprising a track disposed along at least one side of the first evaporator and through which track the first door member passes when the first door member is moved from the rolled position to the unrolled position.

3. The evaporator door system of claim 2, further comprising a rib disposed on the first door member between opposite ends of the first door member and extending along a horizontal width of the first door member, wherein one of the opposite ends of the first door member is connected to the rotatable member.

4. The evaporator door system of claim 3, wherein the rib extends in a direction parallel to the axis of rotation.

5. The evaporator door system of claim 1, further comprising a motor coupled to the rotatable member, the motor rotating the rotatable member upon receipt of a signal.

6. The evaporator door system of claim 5, further comprising a sensor that detects the first door member when the first door member has moved to the unrolled position.

7. The evaporator door system of claim 6, wherein the controller is connected to the sensor and controls a direction of rotation of the motor.

8. The evaporator door system of claim 1, further comprising a weight attached to one end of the first door member.

9. The evaporator door system of claim 8, wherein the weight is a metal bar extending substantially across one edge of the first door member.

10. The evaporator door system of claim 9, further comprising a portion of the first door member wrapped around the metal bar.

11. The evaporator door system of claim 1, further comprising a second scraper disposed on a second face of the first door member opposite the first face.

12. The evaporator door system of claim 11, wherein the first and second scrapers are offset toward each other such that the first door member forms an S shape around the first and second scrapers.

13. The evaporator door system of claim 1, wherein the first scraper comprises ultra-high molecular weight polyethylene.

14. The evaporator door system of claim 1, further comprising a coating disposed on the first door member.

15. The evaporator door system of claim 14, wherein the coating is polyvinylchloride.

16. The evaporator door system of claim 1, further comprising a hood disposed around the first door member and the rotatable member.

17. The evaporator door system of claim 16, wherein the hood includes a pitched surface so as to drain any moisture in a direction away from the first door member.

18. The evaporator door system of claim 17, wherein the hood comprises a shell and a layer of insulation.

19. The evaporator door system of claim 1, further comprising a duct connected to an evacuation device and configured to evacuate an area between the first door member and the first evaporator during the defrost operation.

20. The evaporator door system of claim 1, wherein the first door member comprises a woven fabric.

21. The evaporator door system of claim 20, wherein the woven fabric is nylon.

22. The evaporator door system of claim 1, further comprising a third door member disposed on a side of the evaporator opposite the first door member such that the first evaporator is disposed between the first and third door members when both of the first and third door members are in an unrolled state.

23. A door system for partially isolating an evaporator, the door system comprising:

a first refrigeration-driven evaporator that cools an environment using a compressed refrigerant;

a second refrigeration-driven evaporator that cools the environment using the compressed refrigerant;

a first rotatable member, configured to be attached proximate to each of the first and second evaporators, respectively, that rotates about an axis of rotation;

a first door member rolled around the first rotatable member and movable from a rolled position to an unrolled position in which the first door member extends farther away from the first rotatable member than when the door member is in the rolled position;

a second door member rolled around a second rotatable member and movable from the rolled position to the unrolled position in which the second door member covers more of the second evaporator than when the second door member is in the rolled position;

a track configured to guide the first door member as the first door member moves from the rolled position to the unrolled position;

a programmable controller including programmed instructions, which when executed, the controller controls the evaporator door system based on a predetermined schedule such that the first door member is in the unrolled position during a defrost operation performed on the first evaporator and the second door member is in the rolled position during the defrost operation performed on the first evaporator and a first scraper disposed in contact with a first face of the first door member.

24. The door system according to claim 23, further comprising a second door member rolled around a second rotatable member disposed in parallel with the first rotatable member.

* * * * *